US006460969B1

(12) United States Patent
Pinkernell

(10) Patent No.: US 6,460,969 B1
(45) Date of Patent: Oct. 8, 2002

(54) METHOD AND APPARATUS FOR MULTIPLEXED WET-DYE PRINTING

(75) Inventor: David W. Pinkernell, Washougal, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/819,594

(22) Filed: Mar. 28, 2001

Related U.S. Application Data

(63) Continuation of application No. 09/311,919, filed on May 14, 1999.

(51) Int. Cl.[7] ..... B41J 2/21

(52) U.S. Cl. ..... 347/43; 347/12; 347/15; 347/16

(58) Field of Search ..... 347/12, 19, 40, 347/43, 15, 16

(56) References Cited

U.S. PATENT DOCUMENTS 5,754,198 A * 5/1998 Nishikawa ..... 347/43
5,984,446 A * 11/1999 Silverbrook ..... 347/3

* cited by examiner

*Primary Examiner*—Lamson Nguyen

(57) ABSTRACT

A wet-dye hard copy apparatus includes a scanning carriage selectively movable along a scan axis and a plurality of ink-jet writing instruments on the carriage for printing on adjacent print media transported along an orthogonal axis. The writing instruments are offset a predetermined distance in the direction of medial travel to increase throughput and to allow simultaneous multiple page printing.

11 Claims, 3 Drawing Sheets

METHOD AND APPARATUS FOR MULTIPLEXED WET-DYE PRINTING

CROSS REFERENCE TO RELATED APPLICATION

This is a continuation of copending application Ser. No. 09/311,919 filed on May 14, 1999.

BACKGROUND OF THE INVENTION

1. Field of the Invention

The present invention relates generally to wet-dye, hard copy apparatus, more particularly to staggered pen arrangement in ink-jet printers, and more specifically to a method of improved throughput printing, including simultaneous printing on multiple pages.

2. Description of Related Art

The art of wet-dye printing—such as with ink-jet technology, liquid toner laser technology, and the like—is relatively well developed. For example, commercial ink-jet products such as computer printers, graphics plotters, copiers, and facsimile machines employ ink-jet technology for producing hard copy. The basics of ink-jet technology are disclosed, for example, in various articles in the Hewlett-Packard Journal, Vol. 36, No. 5 ( May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in Output Hardcopy [sic] Devices, chapter 13, (Ed. R. C. Durbeck and S. Sherr, Academic Press, San Diego, 1988).

In U.S. Pat. No. 5,376,958 (assigned to the common assignee of the present invention and incorporated herein by reference) for Staggered Pens in Color Thermal Ink-Jet Printer to Brent Richtsmeier, et al. (hereinafter "Richtsmeier"), a color ink-jet printer includes a print carriage movable along a carriage scan axis and a plurality of color producing ink-jet printheads supported by the print carriage and offset relative to each other so that their nozzle arrays are non-overlapping along the media scan axis (perpendicular to the carriage scan axis). The nozzle arrays of the ink-jet printheads traverse non-overlapping regions as the carriage is scanned along the carriage scan axis. The construct thus provides for drying of ink drops prior to application of any overlying ink drops.

Generally, the pen scanning axis is referred to as the x-axis, the print media transport axis is referred to as the y-axis, and the ink drip firing direction is referred to as the z-axis. See e.g., FIGS. 1–3.

It is a perennial goal of hard copy apparatus designers to increase throughput, an important consideration for the end-user. Thus, among hard copy apparatus original equipment manufacturers, the design criteria is "faster is better." For scanning carriage ink-jet technology, the goal is to try to match the substantially faster page-per-minute ("ppm") capability in state-of-the-art electrostatic and laser printing technology.

In thermal ink-jet technology, the use of thin-film and semiconductor technology to produce printheads has permitted the nozzle density to increase. In other words, where only a few years ago Hewlett-Packard™ DeskJet™ Stanley-model printheads had a nozzle array height of about one-sixth inch with nozzles separated by 1/180th-inch, the state of the art has progressed to where nozzle arrays of one or more inches in height with hundreds of nozzles separated by only 1/600th-inch. It can thus be recognized that in a standard ink-jet scanning printer, throughput efficiency is degraded with the larger printheads because many nozzles will not be firing as swaths are created along leading and trailing edges of the print media, namely, when part of the printhead is hanging over the edge of the page.

SUMMARY OF THE INVENTION

In its basic aspects, the present invention provides a method for ink-jet printing, including the steps of: transporting sheets of print media sequentially in a first direction through an ink-jet printing zone such that a leading edge of a print media sheet is substantially adjacent to a trailing edge of a sequentially preceding print media sheet; aligning a set of ink-jet printheads in series in a plane adjacent to the printing zone and parallel to the first direction; and printing a first swath in a second direction perpendicular to the first direction with one of the ink-jet printheads of the set on or adjacent to the leading edge while simultaneous printing a second swath with another one of the ink-jet printheads of the set on or adjacent to the trailing edge.

In another basic aspect, the present invention provides an ink-jet hard copy apparatus, including: carriage mechanisms for moving along a carriage scan axis; transport mechanisms for transporting print media sequentially through a printing zone along a media transport axis that is substantially orthogonal to the carriage scan axis; and a plurality of ink-jet printheads supported by the carriage mechanisms in sequential locations along the media transport axis, each of the printheads having at least one nozzle array having a height in the media transport axis, and the printheads are offset in the media transport axis relative to each other by approximately a distance less than or equal to the height when the pens have the same color ink and equal to or greater than the height when the pens have different color ink.

In another basic aspect, the present invention provides a color ink-jet hard copy apparatus, having: a printing zone; a paper feed device mounted for transporting paper sheets sequentially through the printing zone along a predetermined paper path, sequentially transported sheets having a respective trailing edge leading edge first gap along the paper path; a scanning carriage mounted with respect to the paper path adjacent to the printing zone for moving along a scan axis that is substantially orthogonal to the paper path; and a set of ink-jet writing instruments mounted to the carriage for depositing droplets of ink on paper sheets transported adjacently thereto by the paper feed device, each of the writing instruments including at least one ink-jet printhead, each printhead including at least one nozzle array having a predetermined array height in a direction along the paper path, the set further having at least two black ink writing instruments mounted to the carriage in series along the paper path such that the respective printheads of the black ink writing instruments are separated from each other by second gap having a distance of at least approximately the predetermined array height, and at least two color ink writing instruments mounted to the carriage in series along the paper path such that the respective printheads of the black ink writing instruments are separated from each other by a distance of at least approximately the predetermined array height and staggered from the black ink writing instruments in the scan axis such that one of the color ink writing instruments is mounted adjacent to the second gap.

It is an advantage of the present invention that it provides for simultaneous multi-page printing.

It is an advantage of the present invention that it provides significantly increased throughput capability for ink-jet hard copy apparatus.

It is an advantage of the present invention that it maximizes printing speed in scanning printhead, single pass, printing.

It is an advantage of the present invention that it can be scaled as printhead size increases.

It is another advantage of the present invention that hard copy apparatus throughput advantages increase as the print swath size increases.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable. For convenience of explanation, the invention will be described with an exemplary embodiment of an ink-jet printer using water-based, dye-based pigment-based, or other inks as would be known in the art. Use of this exemplary embodiment is not intended to be a limitation on the scope of the invention nor should any such intention be implied; this should be understood as a generic example for any wet-dye printing apparatus implementation. The term "paper " is used hereinafter as being synonymous with all forms of print media in the state of the art, such as plain paper, special paper, transparencies, card-stock, envelopes, and the like.

Figure 1:
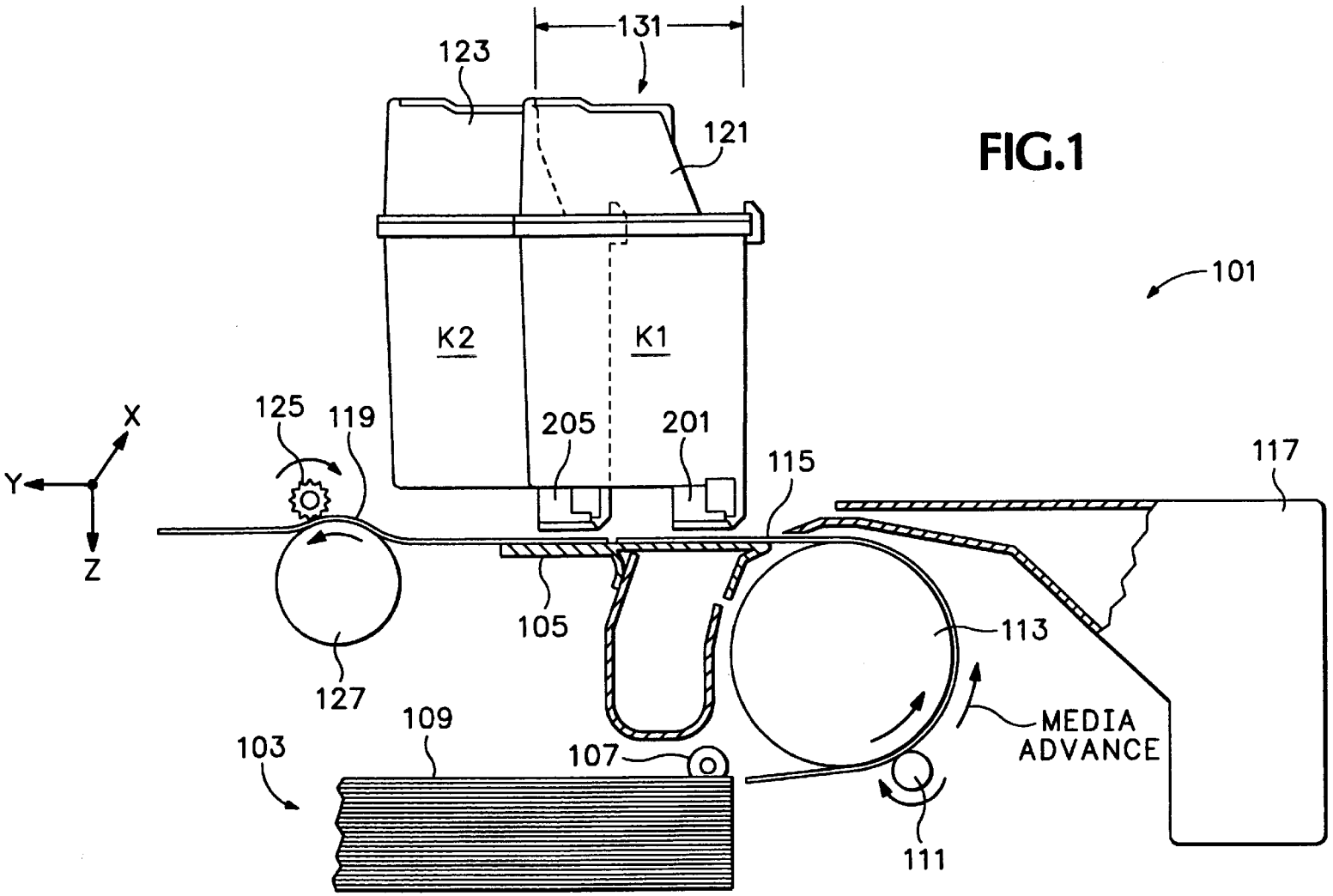
FIG. 1 is an elevation view, schematic representation of an ink-jet printer in accordance with the present invention.

FIG. 1 schematically represents a hard copy apparatus in the form of an ink-jet printer 101. A stack 103 of cut-sheet paper is positioned appropriately such that individual sheets can be sequentially fed to a platen 105 which is in a printing zone 131 of the apparatus. A sheet pick device 107 picks and delivers the top sheet 109 of the stock 103 to a paper pinch roller 111 and its associated paper transport wheel 113. A picked sheet 115 is advanced by the combination roller 111 and wheel 113 feed such that the leading edge of the sheet is fed to the printing zone 131 by a paper guide 117. Other paper feed mechanisms, such as tractor-feed, vacuum, drum, belt feed, and the like, can also be employed.

Figure 2:
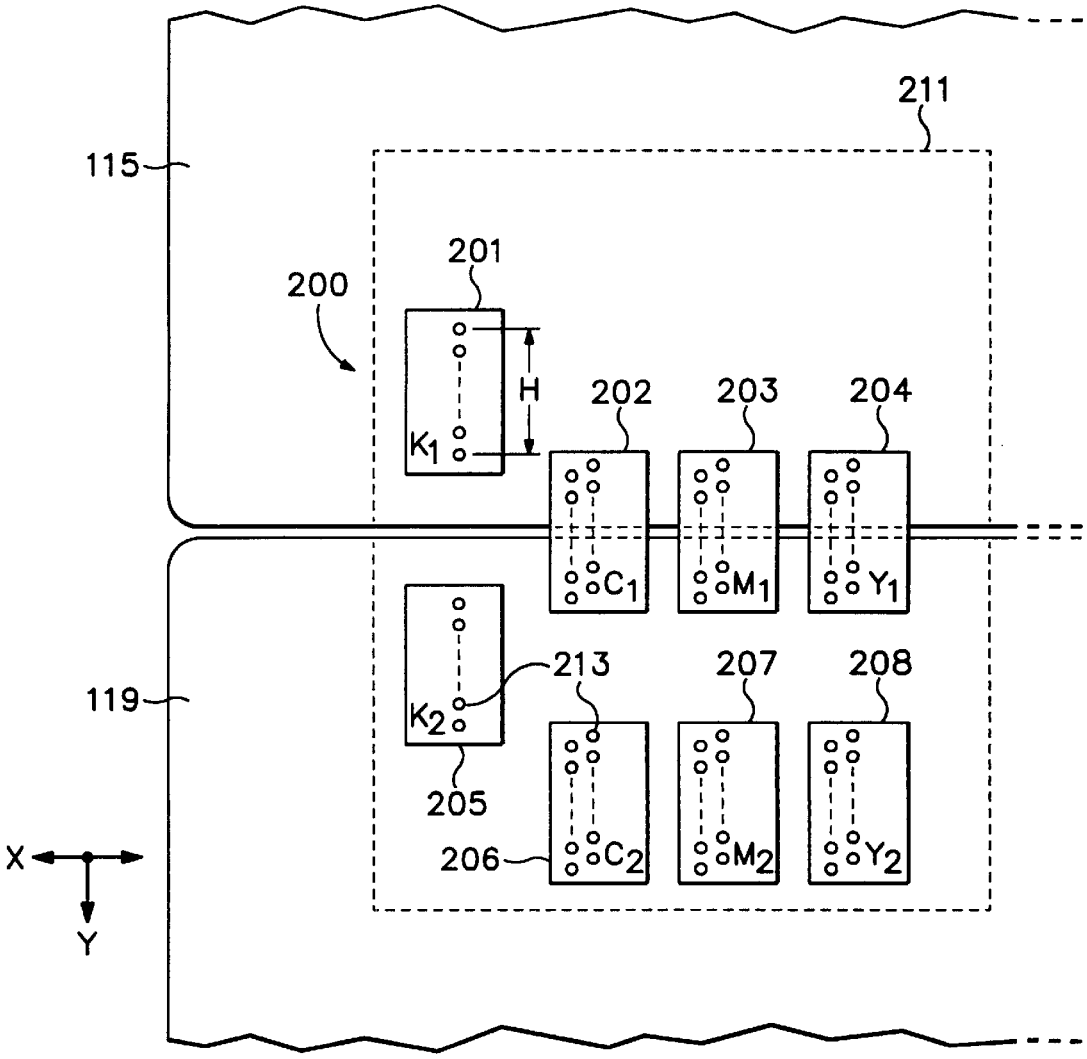
FIG. 2 is a plan view (top) of an ink-jet printhead alignment configuration for a color ink-jet printer in accordance with the present invention.

At the printing zone 131, there are at least two ink-jet print cartridges 121, 123. Turning also now to FIG. 2, for a full color printer implementation of the present invention, one exemplary embodiment arrangement for a set 200 of eight printheads 201 through 208, fixedly mounted in a scanning carriage 211 is depicted. Note that a variety of other printhead constructs having primary color inks—in this exemplary embodiment cyan ("C") , magenta ("M"), yellow ("Y") and black ("K") ink—can be employed. The cartridges can be offset, as shown in FIG. 1 or similarly to the Richtsmeier patent, or linearly arrayed as shown in FIG. 2. As will be known tho those skilled in the art, a color ink-jet writing instrument can also be configured as a single pen or cartridge have segregated nozzle arrays for each color ink. There are at least two printheads for each ink employed; this is designated in the FIGURES by the labels "C1/C2, M1/M2, Y1/Y2" and "K1/K2."

Each printhead 201–208 has an array of drop generators (not shown) which include nozzles 213 for ejecting the ink droplets onto an adjacent sheet of paper in the printing zone 131. The number of nozzles 213 in an array and the number of linear arrays on a printhead can be varied in accordance with the needs of a particular printer design.

Returning to FIG. 1, a black ink, two pen printer 101 such as might be needed for black and white text and line drawing printing only, is depicted at an operational position where a previous, sequential, paper sheet 119 in the paper path of the printer 101 has been captured by a paper ejection mechanism having a paper pinch roller 125 and paper transport wheel 127. Note that because of the intentional stagger arrangement, when only a very small gap, if any, exists between the trailing edge of the sequentially leading paper sheet 119 and the leading edge of the sequentially trailing paper sheet 115, the cartridge 121 mounted for scanning proximate the paper guide 117 has its printhead 201 automatically positioned over the leading edge of the sequentially trailing paper sheet 115 at the same time that the printhead 205 of the cartridge 123 mounted for scanning distally from the paper guide 117 is over the trailing edge of the sequentially leading paper sheet 119. For cut-sheet paper, it is advantageous to have a gap between the sheets in order to accurately detect the paper position on the platen; thus, the actual gap width is dependent on the resolution capability of the edge detector device (not shown).

Figure 3:
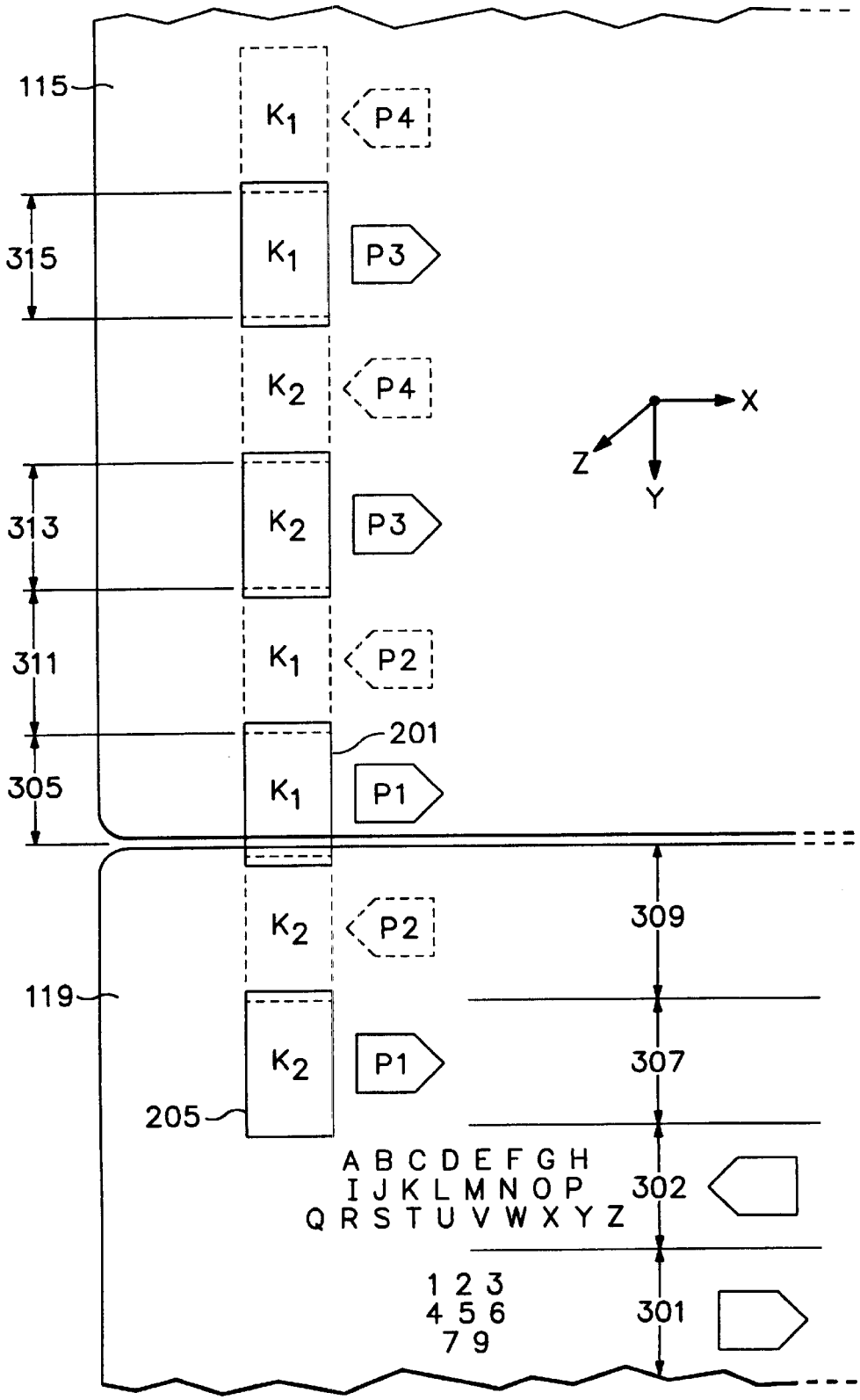
FIG. 3 is a schematic representation for a method of printing in accordance with the present invention.

The methodology is depicted in FIG. 3, showing that the present invention uses a staggered printhead scheme to permit the simultaneous printing on two separate sheets of paper simultaneously. The gap between black ink printheads' 201, 205 nozzle 213 arrays (and in FIG. 2, between the one set of color ink printheads 202–204 and the second set of color ink printheads 206–208) is predetermined as being substantially the same as the height "H" of the nozzle 213 array (FIG. 2 only). The sequentially leading paper sheet 119 is shown as having printed swaths 301, 302 of text from prior scan passes.

As the next paper advance continues in the y-axis, print cartridge 123/K2 has its associated printhead 205 over an unprinted swath region 307 for a swath scanning pass P1. Now, because of small gap, if any, between the leading paper sheet 119 and the trailing paper sheet 115, and because of the increased gap between printheads of like color ink, the unprinted, sequentially trailing, paper sheet 115 has its leading edge marginal area 305 positioned under cartridge 121/K1 with its associated printhead 201. Thus, during the next left-to-right scanning pass P1, a swath 305 on the next sequential sheet of paper 115 is printable simultaneously with printing a swath 307 on the prior sequential sheet 119 in the paper path.

After printing those two swaths 305, 307, the paper is advanced a swath height. Bidirectional printing is generally employed in the state of the art; thus, the next scanning pass P2 is right-to-left. The relative positions of the printheads are now shown in phantom line and designated as K2P2 and K1P2, simultaneously and respectively printing the leading paper sheet 119 trailing marginal swath 309 and a next swath 311 of the trailing paper sheet 115.

As the four swaths 305/311, 307/309 adjacent the paper gap are now all printed, the media can be advanced three swath heights such that for the next scanning pass P3 cartridge 123/K2 and its associated printhead 205 print a swath 313 adjacent the last swath 311 printed by cartridge 121/K1 and its associated printhead 201 while that cartridge 121 prints a swath 315 one full swath height away. Then, a single swath height paper advance moves the cartridges 121, 123 to print adjacent swaths to the just printed swaths 313, 315 during the next pass P4; after which another three swath height paper advance is employed to begin the next cycle of swath printing.

In this manner, both simultaneous printing on two sheets of paper and a ten to twenty percent throughput increase is achieved. As shown in FIG. 2, the same methodology is extended to full color printing. A variety of known manner, or proprietary, printhead drop generator firing algorithms can be employed depending on the specific implementation for both black and white and full color printing.

The present invention can be optimized for any specific implementation by considering factors such as printhead height, paper size, workspace footprint, and the like as would be known in the art. At a minimum the inter-printhead spacing should be approximately equal to the printhead height, "H." When the inter-sheet gap, "G," is a predetermined fixed amount, an optimal inter-printhead spacing is: H+G. Statistically modeling an "average document" can also be used to determine inter-printhead spacing. Extending the principal to a printer where only a single size paper is used, making the inter-printhead space equal to page length would allow the printing of as many pages simultaneously as the workspace footprint would allow; e.g., a color poster printing shop—where throughput is particularly slow in the current state-of-the art—could employ large printers that print two or more posters simultaneously.

The full color implementation as depicted in FIG. 2 is particularly advantageous for color image printing, e.g., photograph reproduction where edge margins are very small or entirely eliminated.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. For example, note that belt drive, vacuum drums, and other paper feed and paper platen systems as would be known in the art can be substituted for the paper transport system shown in this exemplary embodiment. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A method for printing on cut-sheet print media, the method comprising:

transporting sheets of the print media sequentially in a first direction through a printing zone such that a leading edge of a print media sheet is substantially adjacent to a trailing edge of a sequentially preceding print media sheet;

printing a first swath on or adjacent to said leading edge while simultaneous printing a second swath on or adjacent to said trailing edge; and simultaneously printing a plurality of entire pages.

2. The method as set forth in claim 2, comprising:

aligning a set of ink-jet printheads in series in a plane adjacent to said printing zone and parallel to said first direction, and said printing further includes printing the first swath in a second direction perpendicular to said first direction with one of said ink-jet printheads of said set while printing the second swath with another one of said ink-jet printheads of said set.

3. The method as set forth in claim 2, comprising:

providing at least one printhead having a swath height sufficient for bridging said leading edge of a print media sheet and the substantially adjacent trailing edge of a sequentially preceding print media sheet, wherein said printing includes simultaneously printing on or adjacent to said leading edge and adjacent trailing edge from said at least one printhead.

4. The method as set forth in claim 2, wherein each of said printheads has a nozzle array having a predetermined array height in said first direction, said aligning comprising:

separating said printheads by a gap in said first direction by a distance of at least equal to nozzle array height of said printheads.

5. The method as set forth in claim 2 wherein said sheets of printed media are transported sequentially separated by a gap between said trailing edge and said leading edge, said aligning comprising:

separating said printheads by a gap in said first direction by a distance of at least equal to nozzle array height of said printheads plus said gap.

6. An ink-jet hard copy apparatus, comprising:

carriage means for moving along a carriage scan axis;

transport means for transporting print media sequentially through a printing zone along a media transport axis that is substantially orthogonal to said carriage scan axis;

a plurality of ink-jet printheads supported by said carriage means in sequential locations along said media transport axis, each of said printheads having at least one nozzle array having a height in said media transport axis, and said printheads are offset in said media transport axis relative to each other such that said printheads are positioned for simultaneously printing sequential print media in the media transport axis, printing the first swath in a second direction perpendicular to said first direction with one of said ink-jet printheads of said set while printing the second swath with another one of said ink-jet printheads of said set, wherein said printheads include a first printhead having a printing swath height for printing a substantially entire first page of said print media, and a second printhead having a swath height for printing a substantially entire second page of said print media trailing said first page through said printing zone.

7. The apparatus as set forth in claim 6, wherein said apparatus has at least one printhead having a swatch height sufficient for bridging said leading edge of a print media sheet and the substantially adjacent trailing edge of a sequentially preceding print media sheet, wherein said printing includes simultaneously printing on or adjacent to said leading edge and adjacent trailing edge from said at least one printhead.

8. A method for printing simultaneously on at least two sheets of cut sheet print media, the method comprising:

tail-gating a first sheet with a second sheet through a printing zone of and ink-jet printer; and substantially simultaneously firing ink-jet nozzles of the ink-jet printer such that at least one first swath of print is deposited substantially on a trailing edge of the first sheet and at least one second swath of print is deposited substantially on a leading edge of the second sheet wherein each of said first swath and said second swath respectively contains substantially an entire print content for each of said two sheets wherein two complete pages of print content are printed substantially simultaneously.

9. The method as set forth in claim 8 wherein print content of each said swath is identical.

10. The method as set forth in claim 8 wherein print content is of each said swath is unidentical.

11. A method for printing simultaneously on at least two sheets of cut sheet print media, the method comprising:

moving a first sheet trailing edge substantially adjacent to a second sheet leading edge through a printing zone of an inkjet printer; and substantially simultaneously firing inkjet nozzles of the inkjet printer such that at least one first swath of print is deposited substantially on a trailing edge on the first sheet and at least one second swath of print is deposited substantially on a leading edge of the second sheet, wherein print content of each said swath is identical.

* * * * *